US006837598B2

(12) United States Patent
Marcus

(10) Patent No.: US 6,837,598 B2
(45) Date of Patent: Jan. 4, 2005

(54) LIGHTING DEVICE

(75) Inventor: Armin Marcus, Wuppertal (DE)

(73) Assignee: Happich Fahrzeug-und Industrieteile GmbH (DE)

( * ) Notice: Subject to any disclaimer, the term of this patent is extended or adjusted under 35 U.S.C. 154(b) by 0 days.

(21) Appl. No.: 10/068,068

(22) Filed: Feb. 6, 2002

(65) Prior Publication Data

US 2002/0110000 A1 Aug. 15, 2002

(30) Foreign Application Priority Data

Feb. 15, 2001 (DE) ..... 101 06 961

(51) Int. Cl.[7] ..... F21V 21/00

(52) U.S. Cl. ..... 362/374; 362/235; 362/236; 362/237; 362/244; 439/419; 439/658

(58) Field of Search ..... 362/227, 249, 362/252, 244, 235, 236, 237, 374; 439/419, 658, 659, 731

(56) References Cited

U.S. PATENT DOCUMENTS 5,113,329 A * 5/1992 Lin ..... 362/238
5,672,000 A * 9/1997 Lin ..... 362/249
5,944,463 A * 8/1999 Savage, Jr. ..... 409/419
6,017,241 A * 1/2000 Komai ..... 439/419
6,328,593 B1 * 12/2001 Chang et al. ..... 439/419

FOREIGN PATENT DOCUMENTS

DE 19627856 A1 1/1998

* cited by examiner

*Primary Examiner*—Thomas M. Sember
*Assistant Examiner*—Jacob Y. Choi
(74) *Attorney, Agent, or Firm*—Ostrolenk, Faber, Gerb & Soffen, LLP

(57) ABSTRACT

A lighting device having a three-way conductor strip with three conductors extending in an axial direction and electrically connected at intervals to LED elements arranged in a row. Each LED element is in a plastic housing which surrounds the LED and the conductor strip, is light emitting and may have a lens over the LED. The housing includes two shells fixed together, and with supporting elements therein for an LED element, an adjacent axial conductor strip area and a heat activatable electrically conductive material. The three-way conductor strip comprises a continuous positive conductor, a continuous negative conductor and an interrupted central conductor that extends from LED element to LED element.

24 Claims, 6 Drawing Sheets

LIGHTING DEVICE

BACKGROUND OF THE INVENTION

The invention relates to a lighting device having a three-way conductor strip which, in the axial direction, is electrically conductively connected to LED elements arranged one behind another in a row. Each LED element is held by a plastic housing which also surrounds the conductor strip at the level of each LED element and is at least partly translucent.

DE 196 27 856 A1 shows a lighting strip having a lighting device of the generic type. The lighting strip has a multi-way conductor strip, which is fitted with LED elements arranged one behind another in a row. The conductor strip comprises a large number of conductor strip sections which are cut to length and lined up in a row in the axial direction, in each case between two axially adjacent conductor strip sections. A printed circuit board is electrically conductively connected to the strip sections. Each printed circuit board is fitted with an LED element. In this known lighting strip, the individual wires of the conductor strip are sheathed with insulation. The insulation is removed at the end regions of each conductor strip section, and the connection between the respective end of a conductor strip section and the respective printed circuit board is produced by electrically conductive contact elements. In each case, a crimp connection is provided between the contact elements and the wires of the conductor strip section, and in each case a riveted connection is provided between the contact elements and the conductor tracks of the printed circuit board. In the known illumination strip, the end regions of the conductor strip sections, the contact elements, the printed circuit boards and the LED elements are in each case encapsulated in a plastic housing which is at least partially translucent and is formed by injection-moulding directly with a plastic material.

SUMMARY OF THE INVENTION

On the basis of a lighting device of the type mentioned at the beginning, the invention is based on the object of simplifying it significantly with respect to the indicated prior art, both in terms of configuration and in terms of manufacture.

According to the invention, this object is achieved by a lighting device having a three-way conductor strip having three conductors extending in an axial direction and electrically connected at intervals to LED elements arranged in a row. Each LED element is held in a plastic housing which surrounds the LED and the conductor strip near the LED and is at least partly translucent and may have a lens over the LED. The housing includes two shells that are fixed together and that support the elements therein, including an LED element, an axial conductor strip area and an electrically conductive contacting material. The three-way conductor strip comprises a continuous positive conductor, a continuous negative conductor and an interrupted central conductor that extends from LED element to LED element.

The two-shell design of the plastic housing permits the simple insertion of an LED element, an axial conductor strip area and electrical contact means in one of the half shells, the simple production of an electrical connection between the LED element and the respectively necessary conductors belonging to the conductor strip, and simple closure of the plastic housing by means of the top shell. Since the positive conductor and the negative conductor pass through and only the central conductor is designed to be interrupted, the result, as compared with the prior art, is a considerable saving in work, including that relating to the conductor insulation stripping operation.

There is preferably a pure plug-in mounting of the individual parts which have to be electrically conductively connected to one another. This constitutes a solution which can be brought about particularly simply and is particularly cost-effective, particularly since neither a stripping operation nor the insertion of printed circuit boards or the like is necessary for the production of the electrical connections.

Electrically conductive contact is provided through a material disposed between the conductor strip and the LED elements. That conductive contact is preferably via a heat-activatable material, such as a solder paste, a contact adhesive, or the like. The metallic contact elements contacted by the material penetrate the conductor strip insulation around the conductive core of the conductor to make electrical contact with the core and there is connection between the contact elements and the conductive core using the heat-activatable material.

Partial stripping of insulation on the conductor is necessary if use is made of the apparatus just described. But, as compared with the prior art, it offers the advantage of a direct electrical connection between the conductor strip and the LED elements, omitting the printed circuit boards that were previously required.

Making the central conductor a resistance conductor means that resistors still needed in the known lighting strip can be dispensed with, which contributes to simplifying and cheapening the lighting device according to the invention.

The plastic housing around the LED and the conductors is comprised of two shells which are fixed to one another e.g. by integrally molded clip elements on the shells. These shells are complementary holders for the individual conductors of the conductor strip, the LED element and the metal contact elements. Further, there are sealing means between the shells. The shells may be clear e.g., glass clear, and be made of molded, particularly injection-molded, parts made from polycarbonate, for example. There may a lens in the shell over one of the LED's with a shape to distribute light with an emission angle that is greater than 120° and particularly may be 180°. The latter meets the requirements of the IMO (International Maritime Organization, a daughter organization of UNO) for escape-route markings on passenger ships may be met in an optimal way.

BRIEF DESCRIPTION OF THE DRAWINGS

Exemplary embodiments of the invention will be explained below with reference to the drawings, in which.

DESCRIPTION OF THE PREFERRED EMBODIMENTS

Figure 1:
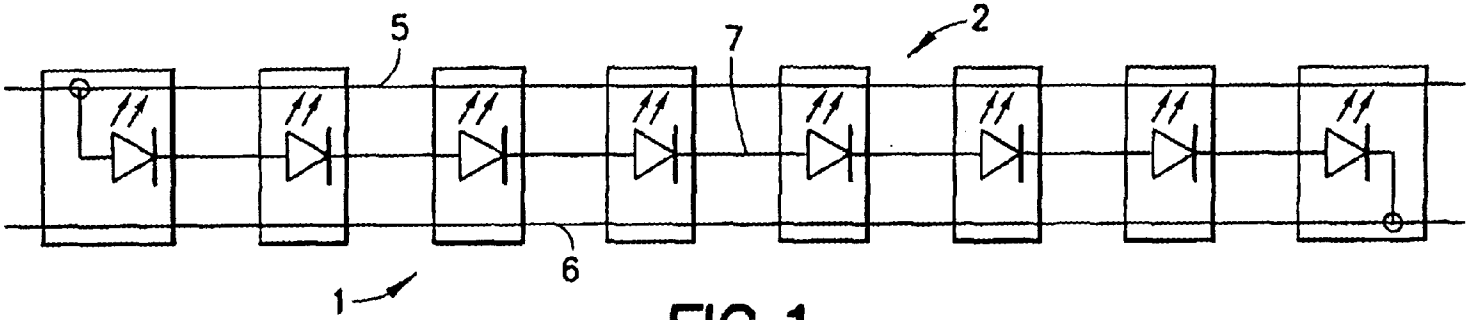
FIG. 1 shows a circuit diagram and a segment fitted with eight LED elements of the lighting device.
Figure 1A:
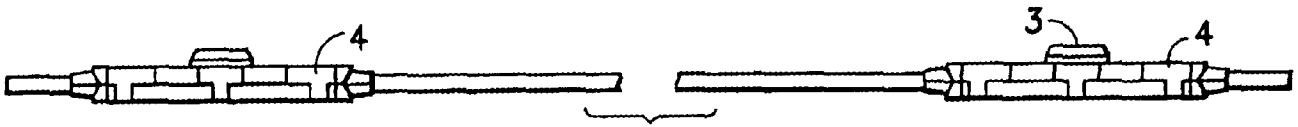
FIG. 1*a* is a side view of a fragment of the assembly of LED elements.
Figure 1B:
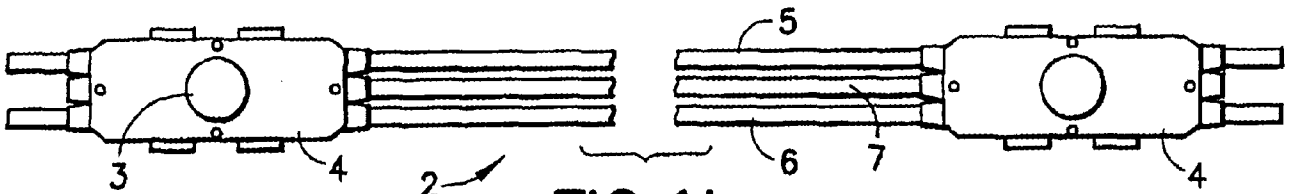
FIG. 1*b* is a top-view thereof.

FIGS. 1, 1*a* and 1*b* show, in the manner of a circuit diagram, a segment 1 of a lighting device comprising a plurality of segments lined up in a row. The lighting device has a three-way conductor strip 2, which is conductively connected to a plurality of LED elements 3 arranged one behind another in a row. Each LED element 3 is accommodated in a plastic housing 4 which also surrounds the conductor strip 2 at the level of each LED element. The housing is preferably of glass-clear design (cf. also FIG. 1*a*).

The segment 1 according to FIG. 1 has eight LED elements 3 each arranged in a plastic housing 4. (It is also possible for more or fewer LED elements to be provided.) The segment also has conductor strip 2 with a continuous positive conductor 5, a continuous negative conductor 6 and a central conductor 7, lined up seven times in a row in the exemplary embodiment according to FIG. 1, as a resistance cable. In a trial arrangement, a central conductor lined up seven times in a row and designed as a resistance cable with 90.3 ohms per segment 1 has proven to be particularly expedient. As can be seen from the plastic housing 4 in FIG. 2, each plastic housing 4, has a two-shell design with a first shell 9 and a second shell 10. In the exemplary embodiment of FIG. 2, the first shell 9 forms the upper 5 housing shell and the second shell 10 forms the lower housing shell. The shells 9 and 10 can be fixed to each other by clip elements 8. The shells have complementary holders 11 of half-round configuration to hold the continuous positive conductor 5, the continuous negative conductor 6 and the central conductor 7 interrupted in the area of each plastic housing 4, and also a circumferential holding groove for an adhesive (not shown) that also has sealing properties.

Figure 5:
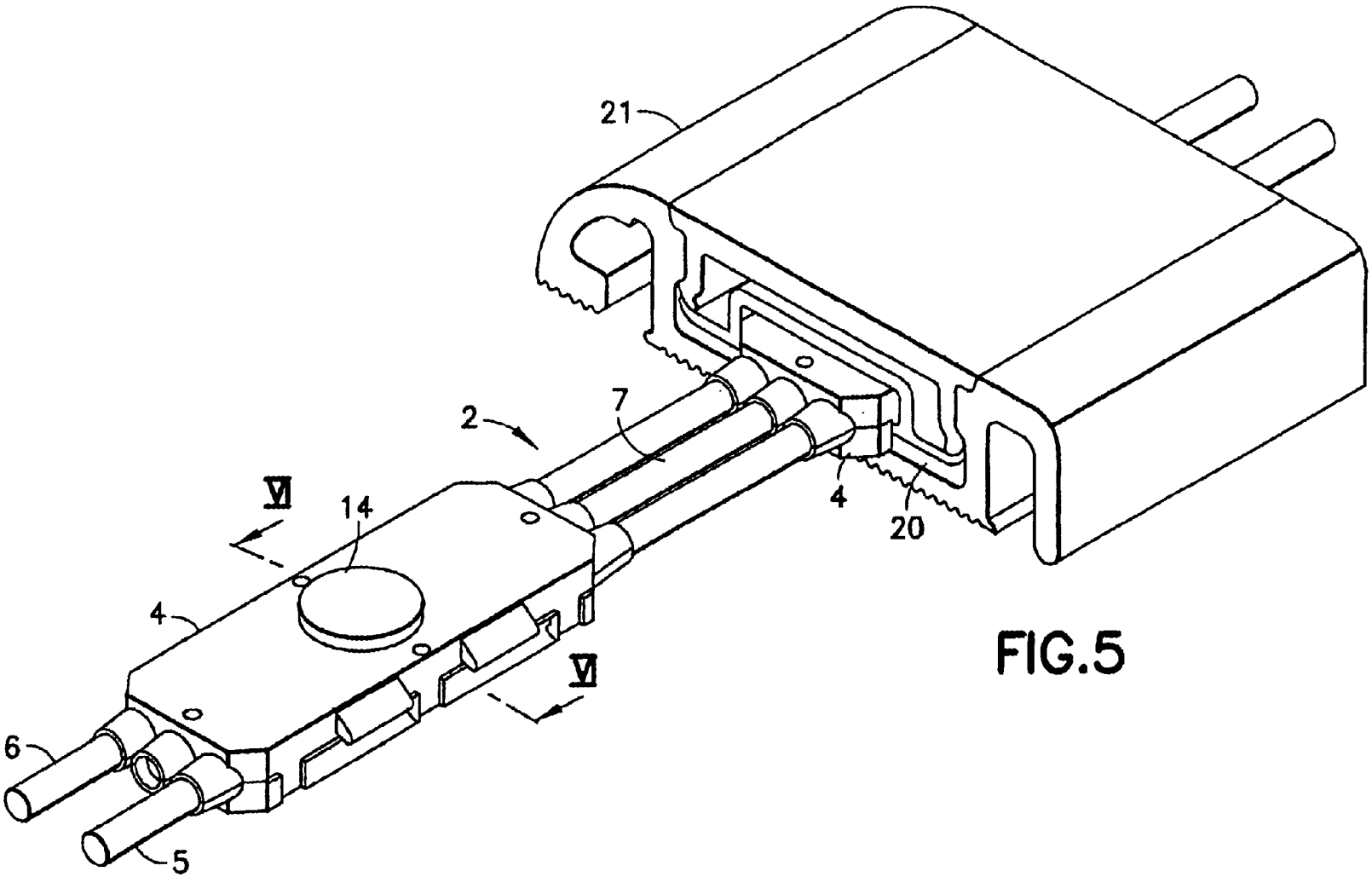
FIG. 5 shows the plastic housing according to FIGS. 3 and 4 with a conductor strip, which is led onward to an adjacent plastic housing held by a profiled strip.

In a recess 13 in the first shell 9, which opens into a lens 14 shown, for example, in FIG. 5, there is situated an LED element 3 which is plugged into the recess. In order to produce electrical contact between the LED element 3, the positive conductor 5 (or the negative conductor 6) and the central conductor 7, use is made of means not shown here, preferably in the form of a contact adhesive material 32 (shown separated from the groove in which it would normally be deposited), which is accommodated in a connecting or distributing groove 15 provided in the shell 9. The distributing groove 15 in each case ends at stripped regions of the conductors 5–7, which exposes the respective cores 16.

Figure 2:
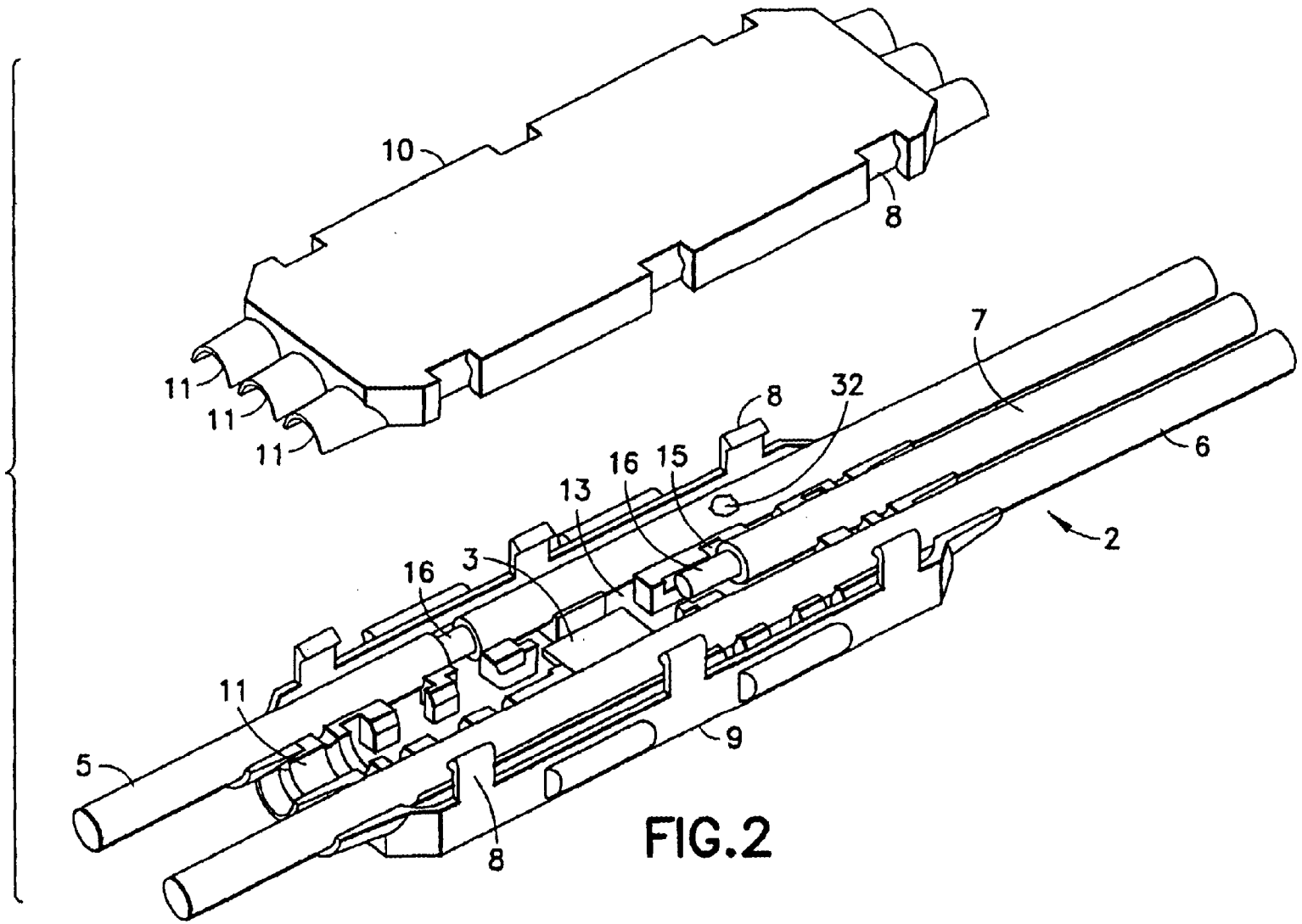
FIG. 2 is an exploded or separated view of a single two-shell plastic housing of a segment according to FIGS. 1 and 1*a*, with an LED element and a conductor strip arranged in a housing shell.

Fabrication of a lighting device with plastic housings 4 and connecting means according to FIG. 2, may be done approximately as follows: the upper shells (first shells 9) of two segments 1, if possible, are held by an elongate device table, not shown. The continuous positive conductors 5 and negative conductors 6 have their insulation stripped in the necessary areas and, while continuously tensioned, they are inserted into the holders 11 belonging to the first shells 9. The central conductor 7 is stripped to length and likewise inserted into the associated holders 11. The LED elements 3 are also inserted into the recesses 13. Electrical connection is then carried out by applying a heat activatable contact adhesive 32 and by activating the contact adhesive, for example in a warm oven or by means of local heating devices. The lower shells (second shells 10) are put onto the upper shells and clipped to the latter. The lighting device, fabricated to this extent on the device table, can then be sealed off with a displaceable adhesive metering system, the sealing referring to the plastic housing 4 and to the sealing and permanent fixing of the shells 9 and 10 to each other. In order to supply the adhesive, the second shells 10 can be provided in each case with an adhesive feed opening (not shown) and, if necessary, in each case also with a venting opening (not shown).

Figure 3:
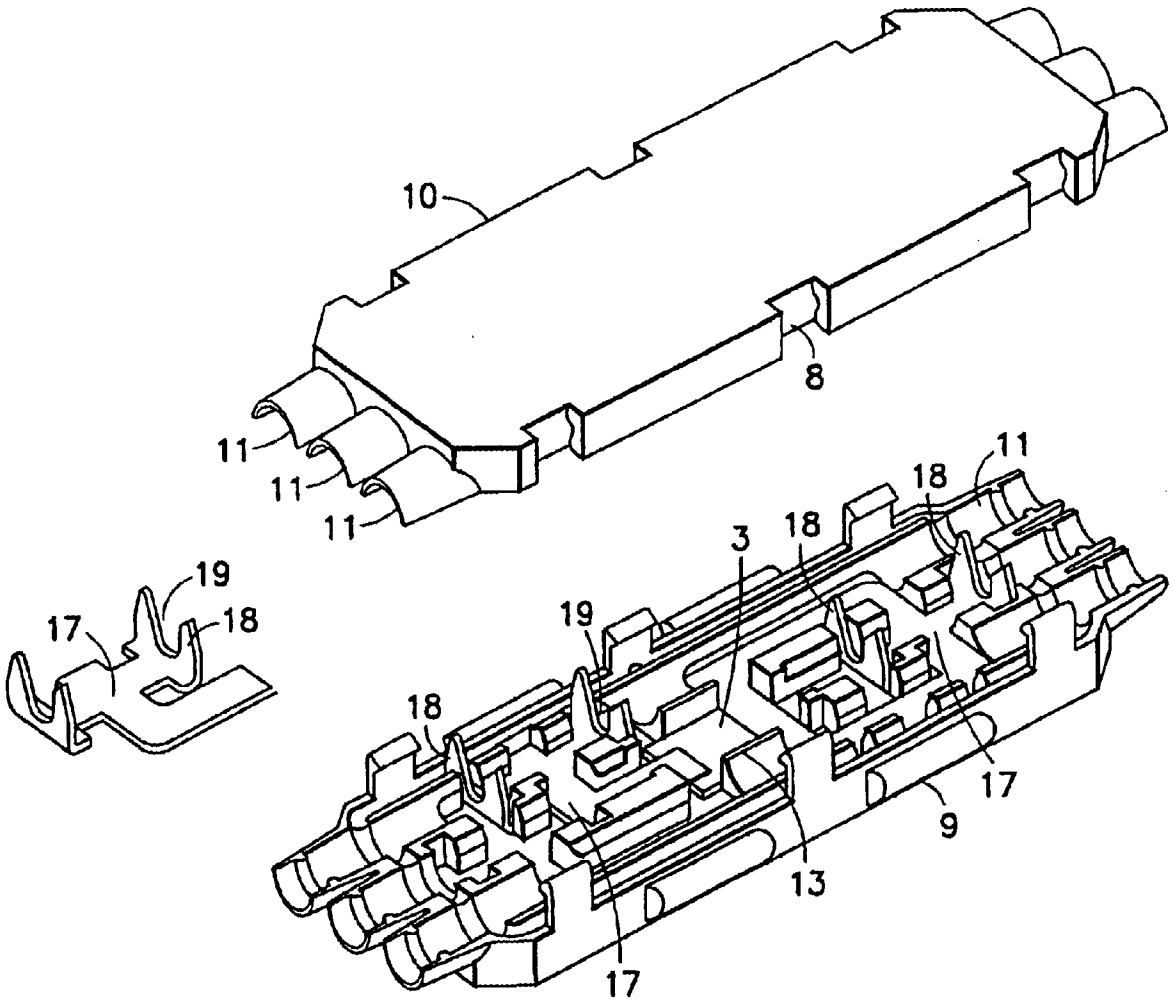
FIG. 3 shows a two-shell plastic housing in an embodiment fitted with metallic contact elements, without a conductor strip.
Figure 4:
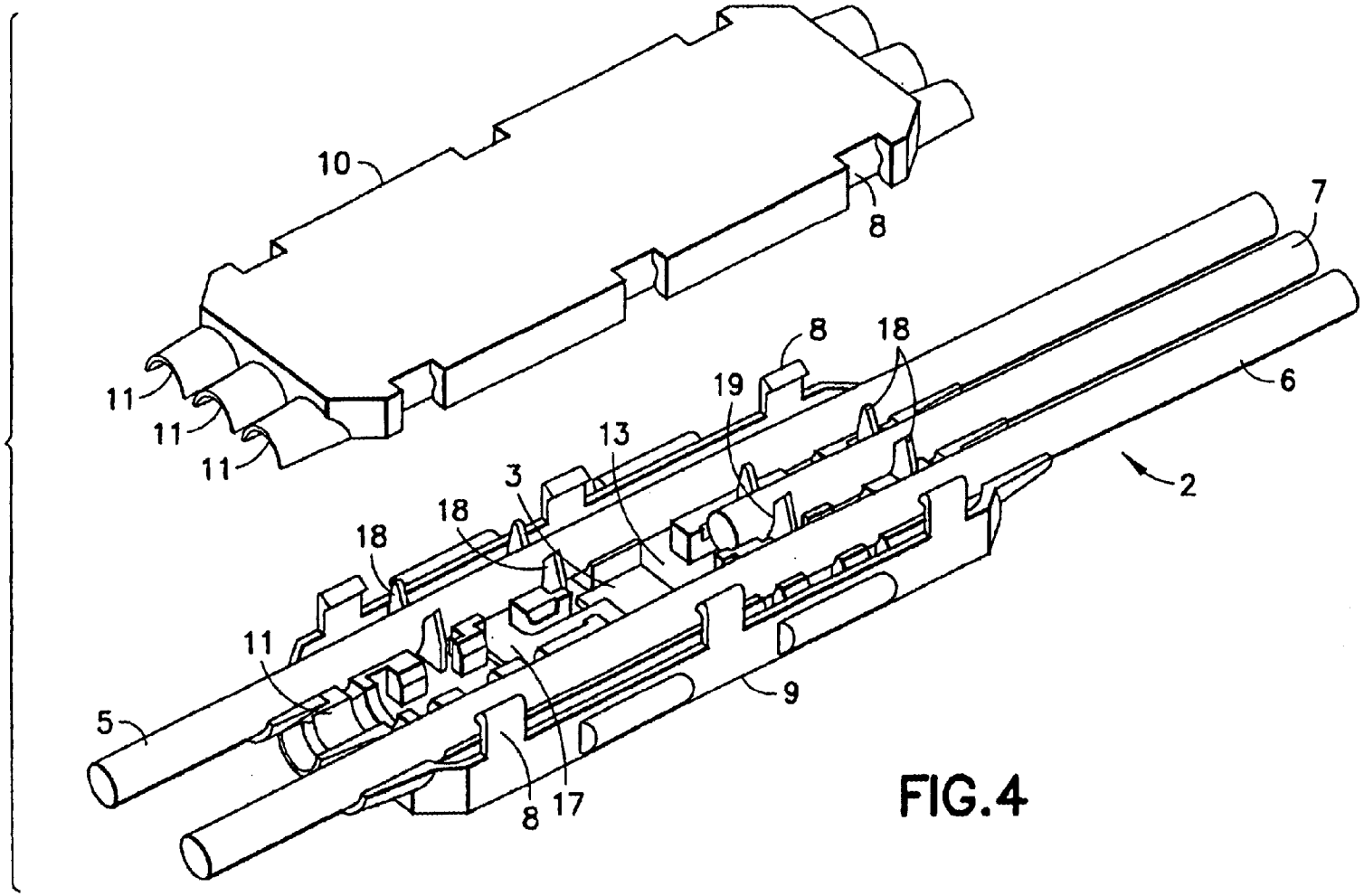
FIG. 4 shows the plastic housing according to FIG. 3 with a conductor strip.

In the embodiment according to FIGS. 3, 4 and 5, the first shell 9 forms the upper housing shell, which is designed with the lens 14, which is molded on in one piece and from the same material, and the second shell 10 forms the lower housing shell. Provided in the shell 9 are holders for the conductors 5–7, a recess 13 for an LED element 3, if necessary a circumferential accommodating groove for a sealing/adhesive means (not shown), and clearances for the arrangement of metallic contact elements 17, which are supplemented by corresponding holders and the like in the second shell 10.

The electrical contact elements 17 are formed, for example, from tinned copper sheet and are configured in such that they come into contact firstly in each case with an LED element 3 and secondly with the positive conductor 5 (or negative conductor 6) and the central conductor 7. The metallic contact elements 17 have material lugs 18 which are bent over upwards and have recesses 19 which are accessible from above. The edges of the recess are formed as cutters to cut through the insulation surrounding the core 16 of the positive conductor 5, the negative conductor 6 and the central conductor 7. The width of the opening of the recesses 19 has to be matched to the respective conductor diameter to ensure reliable severing of and reliable making of contact with the respective conductor.

Fabrication of a lighting device with plastic housings 4 according to FIGS. 3 and 4, the procedure may be as follows. The contact elements 17 are clipped into the upper shells 9 and the LED is placed on these and clamped. This establishes a reliable electrical connection between the contact elements 17 and the contacts of the LED elements 3. Then, the upper shells (first shell 9) of two segments 1, if possible, are held by an elongated device table, not shown, and the positive conductor 5 and the negative conductor 6, which are continuously tensioned, are inserted into the segments and pressed into the recesses 19 provided with cutters at the contact elements 17. Stripping the conductors 5–7 is neither envisaged nor necessary. The following mounting steps (clipping on the lower shell 10, sealing and adhesive bonding and, if necessary, functional optical testing) correspond to FIG. 2.

FIG. 3 shows the two-shell plastic housing 4 without the conductors 5–7, while in FIG. 4 the plastic housing 4 has been fitted with the conductors 5–7. FIG. 5 reveals the arrangement of the new lighting device in the holder channel 20 in a profiled strip 21, which may be an escape-route marking, orientation, decorative or similar profiled strip 21.

Figure 6:
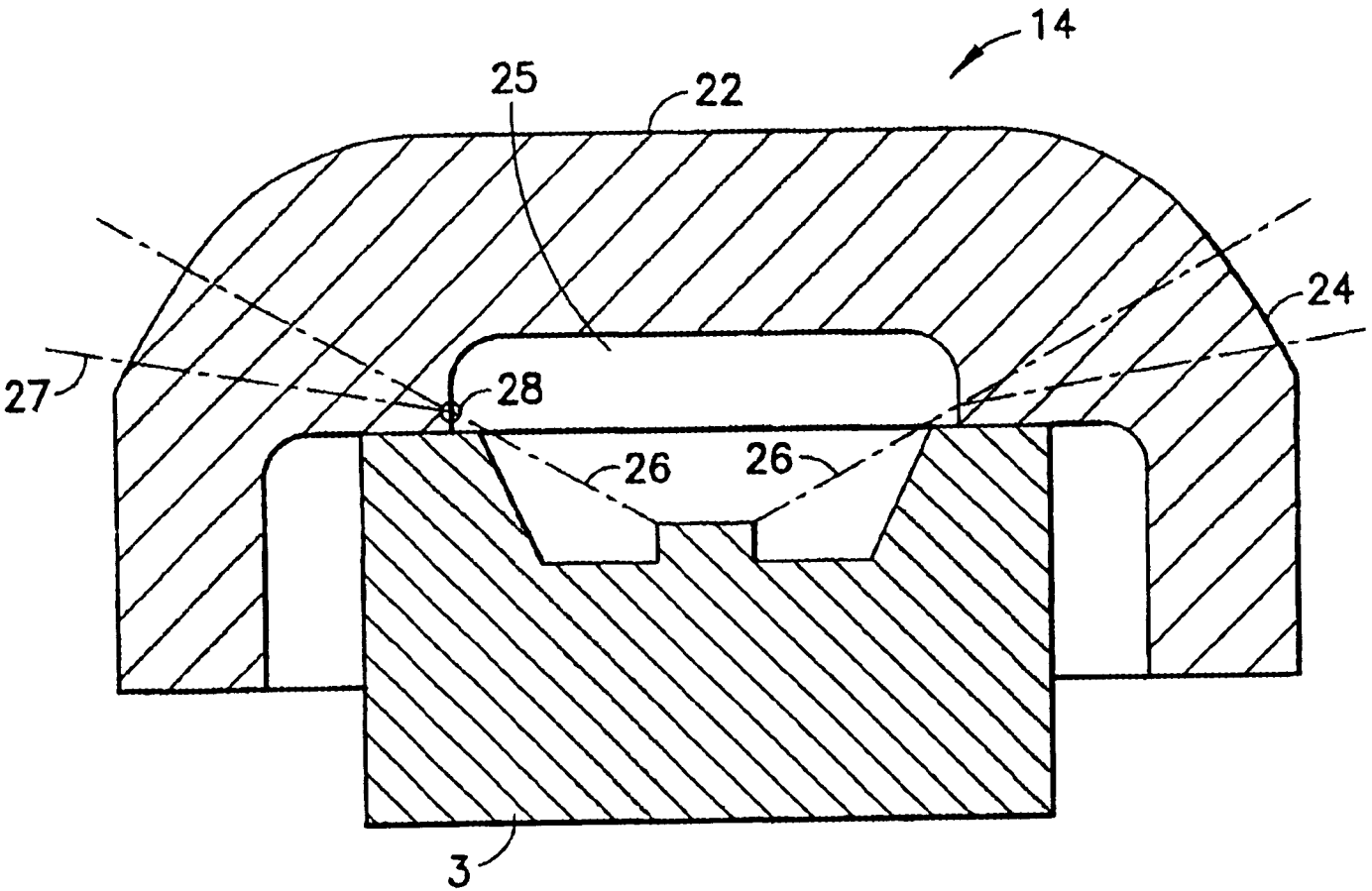
FIG. 6 shows a section V—V from FIG. 5.

A special feature of the novel lighting device which is of independent inventive significance is the design and configuration, shown on a substantially enlarged scale in FIG. 6, of the lens 14 which has already been mentioned. This has a flattened top surface 22, which merges via a radius into a cone 24, whose lower end coincides with the top surface of the shell 10 of the plastic housing 4. Above the LED element 3, the lens 14 has a cylindrical recess 25 with a rounded transition to the bottom of the recess. The cone angle is 30°, with reference to the vertical. The shaping of the lens 14 has been carried out by using the law of refraction and taking account of the material constant of the material used for the manufacture of the lens 14. Using this, as compared with a light distribution with a previously conventional emission angle of 120°, a light distribution with a preferred emission angle of 180° could be achieved. The lines indicate an emission angle of 120°, while the lines 27 indicate an emission angle of 180°, since the rays penetrating into the lens 14 experience an appropriate change in direction at the point 28.

While the lens 14 is shown in the drawings as an integrated constituent part of a housing shell, it is of course within the scope of the invention to provide a separately fabricated lens 14 for each LED element 3. It is also conceivable to use LED elements 3 which, from the start, have lenses 14 which are arranged on them and bridge the light-emitting diodes in the manner shown.

The invention is not restricted to the exemplary embodiments illustrated, but also comprises all the embodiments with the same effect in the sense of the invention. Furthermore, the invention is not restricted to the combinations of features shown, but can also be defined by any other desired combination of specific features of all the individual features disclosed overall.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A lighting device having a three-way conductor strip extending in an axial direction;

LED elements arranged one behind the other in a row and in intervals along the axial direction of the conductor strip; the three-way conductor strip comprises a continuous positive conductor, a continuous negative conductor and an interrupted central conductor that extends from LED element to LED element in the row;

a respective plastic housing containing each LED element, the housing being shaped to also surround the conductor strip at and around the LED element, the housing being at least partly light emitting;

the housing being comprised of a first and a second shell, the first shell being a holding shell configured to hold and holding therein the respective LED element, at least one electrically conductive contact at the LED element in the housing and at an axial direction conductor strip area of the conductor strip;

the second shell is fixable to the first shell by sealing means between the first and second shells.

2. The lighting device of claim 1, wherein the electrically conductive contacts are between the conductor strip and the LED elements, and the conductive contacts are metallic contact elements.

3. The lighting device of claim 2, further comprising heat-activatable conductive material disposed in the housing to provide electric contact between the conductor strip and the LED.

4. The lighting device of claim 3, wherein the heat activatable conductive material comprises solder paste or contact adhesive.

5. The lighting device of claim 2, further comprising a plug-in mounting connecting each metallic contact element with one of the LEDs.

6. The lighting device of claim 2, wherein the conductor strip includes a conductive core with insulation around the core and the metallic contact elements include cutters which penetrate the insulation to make contact with the respective conductor cores.

7. The lighting device of claim 6, further comprising heat-activatable conductive material disposed in the housing to provide electric contact between the conductor strip core and the LED.

8. The lighting device of claim 2, wherein the conductor strip comprises a conductor core and insulation therearound, the conductor strip insulation being partly stripped at the electrically conductive contact means for enabling contact there.

9. The lighting device of claim 8, wherein the conductor strip includes a conductive core with insulation around the core and the metallic contact elements include cutters which penetrate the insulation to make contact with the respective conductor cores.

10. The lighting device of claim 9, wherein the heat-activatable material comprises solder paste or contact adhesive.

11. The lighting device of claim 1, wherein the central conductor is a resistance conductor.

12. The lighting device of claim 1, wherein the shells of the housing including integrally formed clip elements thereon which fix the shells of the housing to one another.

13. The lighting device of claim 1, wherein the shells of the housing include complementary holders for the respective individual conductors of the conductor strip, the respective LED element, and the respective metal contact elements.

14. The lighting device of claim 1, further comprising sealing means for sealing and permanent connection of the shells to each other.

15. The lighting device of claim 3, further comprising holders in at least one of the shells of the housing for the heat-activatable material.

16. The lighting device of claim 1, wherein the shells of the housing are clear molded parts.

17. The lighted device of claim 16, wherein the shells of the housing are glass clear injection-molded polycarbonate parts.

18. The lighting device of claim 1, further comprising a lens supported at the housing and disposed over the LED element.

19. The lighting device of claim 18, wherein the lens is shaped to distribute light with an emission angle no greater than 120°.

20. The lighting device of claim 18, wherein the lens has a shape to distribute light with an emission angle of 108°.

21. The lighting device of claim 1, further comprising a profiled strip in which the lighting device housing is supported and disposed.

22. An LED arrangement for a lighting device, wherein the lighting device includes a three-way conductor strip comprising a continuous positive conductor, a continuous negative conductor and an interrupted central conductor;

the arrangement comprising:

an LED; a light emitting plastic housing shaped to surround the LED and the conductor strip at and around the LED element;

the housing being comprised of a first and a second shell, the first shell being a holding shell configured to hold and holding therein the LED, at least one electrically conductive contact at the LED in the housing and at an axial direction conductor strip area of the conductor strip;

the second shell is fixable to the first shell by sealing means between the first and second shells;

the electrically conductive contact is between the conductor strip and the LED, and the conductive contact is a metallic contact element.

23. The LED arrangement of claim 22, further comprising heat-activatable conductive material disposed in the housing to provide electric contact between the conductor strip and the LED.

24. The LED arrangement of claim 22, wherein the conductor strip includes a conductive core with insulation around the core and the metallic contact elements include cutters which penetrate the insulation to make contact with the respective conductor cores.

* * * * *